United States Patent [19]

Appleby et al.

[11] 4,184,930

[45] Jan. 22, 1980

[54] ELECTROLYZER FOR BASIC SOLUTIONS

[75] Inventors: Anthony-John Appleby, Sevres; Gilles Crépy, Gif sur Yvette, both of France

[73] Assignee: Compagnie Generale d'Electricite, Paris, France

[21] Appl. No.: 825,508

[22] Filed: Aug. 17, 1977

[30] Foreign Application Priority Data

Aug. 24, 1976 [FR] France ..... 76 25579

[51] Int. Cl.[2] ..... C25B 1/00; C25B 1/02; C25B 11/04

[52] U.S. Cl. ..... 204/96; 204/129; 204/252; 429/188; 429/223; 429/235; 429/245

[58] Field of Search ..... 204/129, 96, 290 R, 204/291, 292, 252, 223; 429/223, 235, 188, 245, 96

[56] References Cited

U.S. PATENT DOCUMENTS

| | | | |
|---|---|---|---|
| 2,737,541 | 3/1956 | Coolidge | 429/223 |
| 2,984,607 | 5/1961 | White et al. | 429/223 |
| 3,343,787 | 9/1967 | Matsui | 429/223 |
| 3,377,202 | 4/1968 | Belove | 429/223 |
| 3,597,829 | 8/1971 | Wagner et al. | 429/223 |
| 3,653,967 | 4/1972 | Beauchamp | 429/223 |
| 3,779,810 | 12/1973 | Kanetsuki et al. | 204/96 |
| 3,979,223 | 9/1976 | Kroger et al. | 204/96 |

*Primary Examiner*—R. L. Andrews

*Attorney, Agent, or Firm*—Sughrue, Rothwell, Mion, Zinn and Macpeak

[57] ABSTRACT

An electrolyzer for basic solutions. This electrolyzer is characterized by the fact that the anode comprises a porous conductive material comprising sintered nickel impregnated with a quantity of nickel hydroxide such that the proportion by weight between the nickel hydroxide and the nickel lies between 50 and 75% approximately.

9 Claims, 3 Drawing Figures

ELECTROLYZER FOR BASIC SOLUTIONS

The present invention relates to an electrolyser for basic slolutions, in particular aqueous solutions, of the type in which oxygen is evolved at the anode.

It also relates to a method suitable for manufacture of such an anode.

In known electrolysers operating at ambient or greater than ambient temperatures and pressures, fluctuation in the operating characteristics, in particular in the voltage necessary for electrolysis, is observed as a function of time.

Such a fluctuation results, in the case where basic electrolytes are used, from variations in the structure of the electrodes and in particular of the anode, these variations resulting from the aggresive reactivity of said electrolyte, especially when electrolysis is effected at a greater temperature than ambient temperature.

Preferred embodiments of the present invention mitigate the drawbacks briefly described above.

The present invention provides an electrolyser comprising two electrodes, an anode and a cathode, at least partly immersed in a basic electrolyte with a separator being interposed between said electrodes, wherein said anode comprises a porous conductive material comprising sintered nickel impregnated with nickel hydroxide in a quantity such that the proportion by weight between the nickel hydroxide and the nickel lies substantially between 50 and 75%.

The invention also provides a method of preparation of the anode of the electrolyser, the method comprising the successive steps of:

Coating an expanded metal conductor with a nickel and water paste powder;

Drying the paste:

Sintering conductor at a temperature lying between 900° and 1000° C. which is maintained for 10 minutes to 1 hour in a reducing atmosphere; and Impregnating textured electrode obtained.

The particle size of the said nickel powder is of the order of 5 microns and is obtained preferably by thermal cracking of nickel tetracarbonyl.

Other characteristics and advantages of the invention will become apparent from the following description given by way of a purely illustrative example having no limiting character with reference to the accompanying drawings and graphs, in which.

Figure 1:
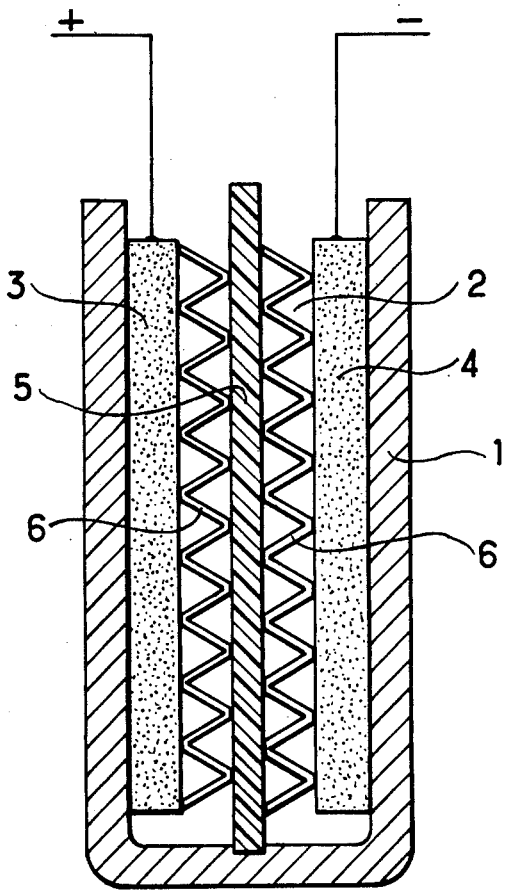
FIG. 1 shows very schematically an electrolyser embodying the invention.

With reference to FIG. 1, the electrolyser comprises a tank 1 containing electrolyte 2 in which electrodes are immersed, namely an anode 3 and a cathode 4 connected to a current generator, not shown. A separator 5 held by spacers 6 is disposed between the electrodes.

The separator 5 is advantageously made of a potassium titanate felt and a binding agent such as polytetrafluorethylene, and it is designed, as is well known, to prevent the interaction of the products which form at the electrodes.

The electrolyte 2 is formed for example by an aqueous potassium hydroxide solution whose concentration lies between normal and twelve times normal and which can also contain a metal compound, in particular a zincate, in a solution.

Advantageously, the cathode 4 comprises a catalyser basically containing cobalt and molybdenum, such as alsewhere described by the Applicant in French Pat. No. 1,592,294 filed on Nov. 18, 1968.

In accordance with the present invention, said anode 3 is made as described hereinbelow.

In the first instance the following mixture is formed:

Nickel powder—1000 gr.

Carboxymethylcellulose—14.5 gr.

Water—1 liter.

The nickel powder used has a particle size of the order of 5 microns and is obtained by thermal cracking of nickel tetracarbonyl Ni. $(CO)_4$.

A thick paste is thus obtained, which is coated on a conductive expanded metal sheet made for example of stainless steel.

After drying, sintering is effected at a temperature lying between 900° and 1000° C. maintained for 10 minutes to 1 hour, in a hydrogen atmosthpere.

According to a preferred embodiment, the sintering temperature is 950° maintained for 30 minutes.

Then, the textured electrode obtained hereinabove is gradually impregnated with nickel hydroxide $Ni.(OH_2)$.

Such an impregnation can be effected by chemical means or by electrochemical means.

The chemical means consists of impregnating by dipping in a nickel nitrate solution followed by treatment with soda.

The electrochemical means consists of disposing the electrode in an electrolytic bath containing nickel nitrate and a reducing agent such as sodium nitrite or alcohol and making hydrogen evolve from said electrode.

Whatever the means chosen, treatment is carried out until the proportion by weight $Ni.(OH)_2/Ni$ lies between 50 and 75%; the porosity then lies between 65 and 80%.

According to a preferred embodiment, said ratio is substantially 65%.

The electrode thus prepared is ready for installation and use in the electrolyser such as described previously.

Figure 2:
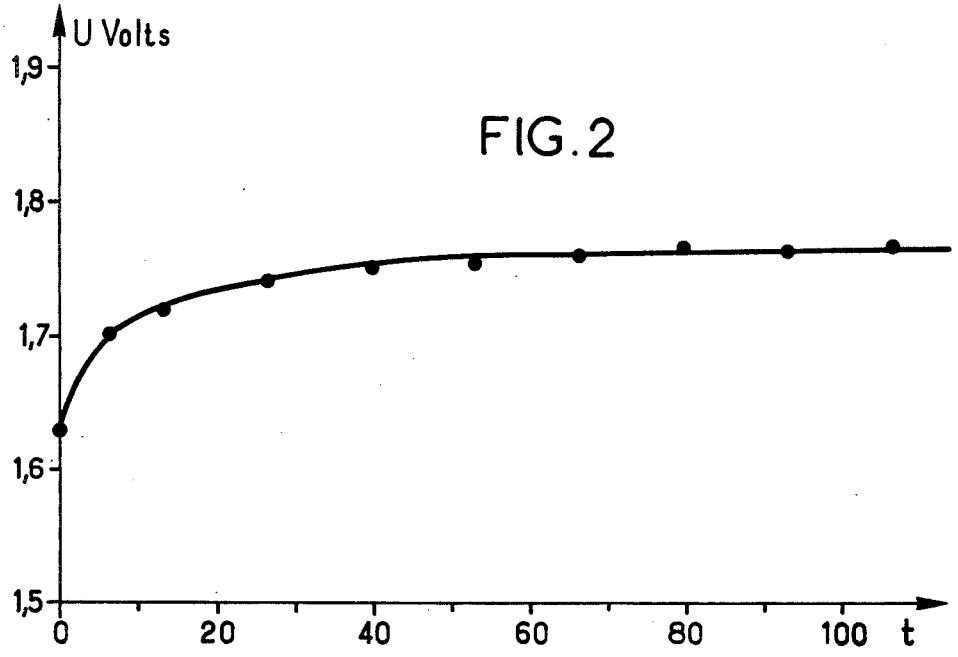
FIG. 2 shows the electrolysis potential U in volts as a function of time t expressed in days.

It will be observed that such an anode makes it possible to provide very stable operation of the electrolyser, as shown in FIG. 2 which shows the electrolysis voltage variation U as a function of time expressed in days at a temperature of 80° C. for an electrolyte formed an 8 N aqueous solution of potassium hydroxide, it being assumed that the separator has been removed, the current density being 400 $mA/cm^2$ and the ohmic drop being 100 mV.

More particularly, it is seen that after a small increase at the beginning, which is to be expected, said voltage is stabilized at substantially 1.75 volts and remains constant over 100 days of operation.

Figure 3:
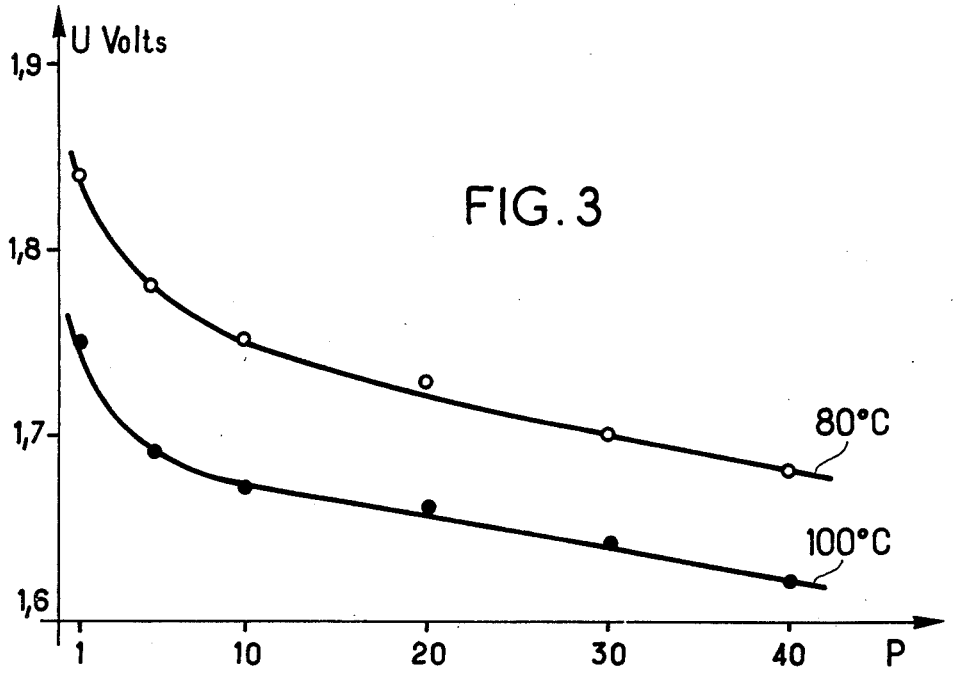
FIG. 3 shows the electrolysis potential U in volts as a function of pressure expressed in bars.

FIG. 3 shows the variation in the electrolysis voltage U as a function of pressure and of the temperature for a current density of 400 $mA/cm^2$. FIG. 3 shows that the increase in these parameters makes it possible to use a lower voltage drop than in ambient pressure conditions. In this case, the ohmic drop is 200 mV for a pressure of 1 bar and 100 mV for a pressure of 40 bar.

It will also be observed that the electrolyser can operate at temperatures of the order of 160° C. without the slightest risk of corrosion by the basic electrolyte, while keeping its advantageous stability characteristics.

Further, it should be stated that with all other conditions equal, the voltage U is about 30% less than that which is necessary for feeding a conventional electrolyser, for a current density of the order of 300 to 500 $mA/cm^2$, e.g. 400 $mA/cm^2$ as previously stated.

Advantageous applications are found for the electrolyser according to the invention for manufacturing hydrogen by electrolysis of an aqueous alkaline solution.

It is also advantageously used for manufacturing zinc by electrolysis of an alkaline zincate solution.

In this respect, it makes it possible to regenerate easily the zinc particles consumed in an electrochemical cell, in particular, and advantageous applications are found for it in the field of electric vehicles.

In all cases, oxygen is evolved at the anode.

It must be understood that the invention is in no way limited to the embodiment described and illustrated, which has been only by way of illustration. In particular, without going beyond the scope of the invention, details can be modified and some arrangements can be changed or some means can be replaced by equivalent means.

For example, the grouping of the electrolysers such as previously described can be contrived in a filter-press type of structure with continous electrolyte flow, without thereby going beyond the scope of the invention.

What we claim is:

1. Electrolyser comprising two electrodes, an anode and a cathode, said cathode comprising a catalyser basically containing cobalt and molybdenum, at least partly immersed in a basic electrolyte, with a separator being interposed between said electrodes, wherein said anode comprises a porous conductive material comprising sintered nickel impregnated with nickel hydroxide in a quantity such that the proportion by weight between the nickel hydroxide and the nickel lies between 50 and 75%.

2. Electrolyser according to claim 1, wherein said electrolyte comprises an aqueous alkaline solution whose concentration lies between normal and twelve times normal.

3. Electrolyser according to claim 2, wherein said electrolyte also comprises zinc solution in the form of a zincate.

4. Electrolyser according to claim 1, wherein said separator is made of a potassium titanate felt and a binding agent.

5. The electrolyser of claim 4 wherein said binding agent is polytetrafluoroethylene.

6. Electrolyser according to claim 1, wherein said porous conductive material impregnated with nickel hydroxide has a porosity lying between 65 and 80%.

7. Method of preparation of the anode of an electrolyser, the method comprising the successive steps of:

Coating an expanded metal conductor with a nickel and water paste powder including a binder;

Drying the paste;

Sintering the conductor at a temperature lying between 900° and 1000° C. which is maintained for 10 minutes to 1 hour in a reducing atmosphere; and Impregnating the textured electrode with nickel hydroxide in a proportion by weight of nickel hydroxide to nickel of between 50 and 75% until the porosity thereof is between 65 and 80%, said impregnation being performed by evolving hydrogen at the electrode in an electrolytic bath containing nickel nitrate and an alcohol or sodium nitrite, as a reducing agent.

8. Method according to claim 7, wherein said nickel powder has a particle size of the order of 5 microns.

9. Method according to claim 8 wherein said nickel powder is obtained by thermal cracking of nickel tetracarbonyl.

* * * * *